US008651837B2

(12) United States Patent
Tetzlaff

(10) Patent No.: US 8,651,837 B2
(45) Date of Patent: Feb. 18, 2014

(54) MODULAR BELLOWS WITH INSTRUMENTATION UMBILICAL CONDUIT FOR ELECTRICAL SUBMERSIBLE PUMP SYSTEM

(75) Inventor: Steven K. Tetzlaff, Owasso, OK (US)

(73) Assignee: Baker Hughes Incorporated, Houston, TX (US)

( * ) Notice: Subject to any disclaimer, the term of this patent is extended or adjusted under 35 U.S.C. 154(b) by 248 days.

(21) Appl. No.: 13/099,946

(22) Filed: May 3, 2011

(65) Prior Publication Data

US 2011/0274565 A1 Nov. 10, 2011

Related U.S. Application Data

(60) Provisional application No. 61/331,555, filed on May 5, 2010.

(51) Int. Cl.

| | |
|---|---|
| ***F04B 35/04*** | (2006.01) |
| ***F04B 17/03*** | (2006.01) |
| ***H02K 5/132*** | (2006.01) |
| ***F04D 13/10*** | (2006.01) |
| ***F04D 13/06*** | (2006.01) |
| ***F04D 13/08*** | (2006.01) |

(52) U.S. Cl.

CPC ..... *F04D 13/10* (2013.01); *F04D 13/0653* (2013.01); *F04D 13/086* (2013.01)

USPC ..... 417/423.3; 417/423.7; 310/87

(58) Field of Classification Search

CPC ..... F04D 13/08; F04D 13/083; F04D 13/086; F04D 13/0653; F04D 13/10; H02K 5/132

USPC ..... 417/63, 423.3, 423.7, 423.14, 424.1, 417/424.2; 166/105, 66.4, 68; 310/87

See application file for complete search history.

(56) References Cited

U.S. PATENT DOCUMENTS

| | | | | |
|---|---|---|---|---|
| 2,379,648 | A | | 11/1937 | Myers |
| 2,258,064 | A | | 5/1938 | Myers |
| 2,455,022 | A | | 8/1944 | Schmidt |
| 2,489,505 | A | | 11/1944 | Schmidt |
| 3,947,709 | A | * | 3/1976 | Waltman ..... 310/87 |
| 4,421,999 | A | | 12/1983 | Beavers |
| 4,436,488 | A | | 3/1984 | Witten |

(Continued)

FOREIGN PATENT DOCUMENTS

| | | |
|---|---|---|
| JP | 1-152940 | 6/1989 |
| WO | WO 96/19590 | 6/1996 |

OTHER PUBLICATIONS

International Search Report and Written Opinion of the International Searching Authority, Oct. 25, 2011, 6 pages.

*Primary Examiner* — Bryan Lettman

(74) *Attorney, Agent, or Firm* — Bracewell & Giuliani LLP

(57) ABSTRACT

An electrical submersible pumping (ESP) system for use in a wellbore having a pressure equalization system that employs modules with a bellows. The bellows axially expands and contracts in response to pressure fluctuations encountered in the wellbore. The modules are attachable in series on a lower end of a motor of the ESP to form the string, where the string can range from a single module to a multiplicity of modules, depending on the application. The bellows has a conduit axially inserted through the bellows that includes an umbilical and has an end in pressure communication with the motor.

9 Claims, 4 Drawing Sheets

(56) References Cited

U.S. PATENT DOCUMENTS

| | | | | |
|---|---|---|---|---|
| 4,492,523 | A | 1/1985 | Knox | |
| 4,558,246 | A | 12/1985 | Tokumitsu | |
| 4,558,247 | A | 12/1985 | Yamamoto | |
| 4,583,923 | A | 4/1986 | James | |
| 4,940,911 | A | 7/1990 | Wilson | |
| 4,966,532 | A | 10/1990 | Fengsheng | |
| 5,193,974 | A | 3/1993 | Hufford | |
| 6,059,539 | A | 5/2000 | Nyilas | |
| 6,242,829 | B1 | 6/2001 | Scarsdale | |
| 6,688,860 | B2 | 2/2004 | Du | |
| 6,981,853 | B2 | 1/2006 | Du | |
| 7,217,107 | B2 | 5/2007 | Du | |
| 7,654,315 | B2 | 2/2010 | Du | |
| 7,806,670 | B2 | 10/2010 | Du | |
| 2002/0192090 | A1 | 12/2002 | Du et al. | |
| 2003/0132003 | A1 | 7/2003 | Arauz et al. | |
| 2004/0146415 | A1* | 7/2004 | Merrill et al. | 417/414 |
| 2007/0074872 | A1* | 4/2007 | Du et al. | 166/369 |
| 2011/0014071 | A1 | 1/2011 | Du | |

* cited by examiner

MODULAR BELLOWS WITH INSTRUMENTATION UMBILICAL CONDUIT FOR ELECTRICAL SUBMERSIBLE PUMP SYSTEM

RELATED APPLICATIONS

This application claims priority to and the benefit of co-pending U.S. Provisional Application Ser. No. 61/331,555, filed May 5, 2010, the full disclosure of which is hereby incorporated by reference herein.

BACKGROUND

1. Field of Invention

This invention relates in general to oil and gas production, and in particular to a pressure equalization system for an electrical submersible pumping (ESP) system.

2. Description of Prior Art

Submersible pumping systems are often used in hydrocarbon producing wells for pumping fluids from within the wellbore to the surface. These fluids are generally liquids and include produced liquid hydrocarbon as well as water. One type of system used employs an electrical submersible pump (ESP). ESPs are typically disposed at the end of a length of production tubing and have an electrically powered motor. Often, electrical power may be supplied to the pump motor via a cable. The pumping unit is usually disposed within the well bore just above where perforations are made into a hydrocarbon producing zone. This placement thereby allows the produced fluids to flow past the outer surface of the pumping motor and provide a cooling effect.

ESPs are generally elongate so they can be inserted within a producing wellbore where the motor usually is on the lowermost end of the ESP assembly. The motor is typically protected by dielectric fluid housed in the ESP motor. A seal section, which also contains dielectric fluid, usually provides pressure equalization between the dielectric fluid and conditions ambient to the ESP. As the ESP is lowered within a wellbore, fluid static head increases well above atmospheric pressure. Without equalizing pressure between the dielectric fluid and ambient, a pressure gradient could be generated sufficient to breach pressure seals in the ESP assembly.

SUMMARY OF INVENTION

Disclosed is an embodiment of an electrical submersible pumping (ESP) system that when inserted in a wellbore is useful for pumping fluid from the wellbore. In an example embodiment the ESP is made up of a pump that is driven by a pump motor and a pressure equalizer for equalizing pressure between the wellbore and inside of the motor. The pressure equalizer is mounted to an end of the pump motor distal from the pump, and can be removed from the pump motor when needed or desired. Bellows are provided with the pressure equalizer, where the bellows have an inside in pressure communication with the pump motor. The bellows also have an outer surface in pressure communication with the wellbore. The pressure equalizer includes a fitting on its end opposite where it attaches to the pump motor; an additional pressure equalizer with bellows can be mounted onto the fitting. A conduit is set axially within the bellows that provides pressure communication between the motor and the fitting. In an alternate embodiment, a second pressure equalizer is included that mounts to the fitting on the first pressure equalizer. The second pressure equalizer has bellows with insides that are in pressure communication with the pump motor, and also has an outer surface that is in pressure communication with the wellbore. In an alternate embodiment, a fitting is set on an end of the second pressure equalizer opposite from its attachment to the first pressure equalizer. The fitting can be used to attach a third pressure equalizer that also has bellows. In an alternate embodiment, a sensor is attached to the fitting on the end of the pressure equalizer. In an alternate embodiment, an umbilical is inserted through the conduit for transmitting data from the sensor to the surface. In an alternate embodiment, the sensor is mounted on the fitting on the end of the second pressure equalizer. In an alternate embodiment, the bellows is an annular member with folds in its side wall that fold and unfold to allow the annular member to stretch or compress as the pressure differential changes between the inside of the bellows and the outer surface of the bellows. In an alternate embodiment, the pressure equalizer is made up of a housing that is around the bellows. An upper end of the bellows can attach within the housing so that a plenum is defined in the space between side walls of the annular member and the lower end. The housing can have a flanged fitting for attaching the pressure equalizer to the motor and for communicating pressure between the inside of the bellows and the motor, and can also have a fluid inlet formed through the housing for providing fluid communication between the wellbore and the outer surface of the bellows. In an alternate embodiment, a thrust assembly is disposed between the pump motor and the pump. In an alternate embodiment, the bellows has a portion with a diameter greater than the diameter of another portion of the bellows.

Also provided herein is a submersible pump assembly for lifting fluids from a wellbore. In an example embodiment the submersible pump assembly includes a pump motor mounted below a pump with a string of pressure equalizers attached on a lower end of the pump motor. The pressure equalizers, which are in series, each have an annular bellows member configured so that an inside of each bellows member is in pressure communication with the pump motor and an outer surface of each bellows member is in pressure communication with the wellbore. Also included in this embodiment is a conduit extending axially through a bellows member. An upper end of the conduit is in pressure communication with the motor and a lower end of the conduit is in pressure communication with a lower bellows member. In an alternate embodiment, each bellows member has an annular member arranged with folds in a side wall of the annular member for selective axially lengthening or shortening of the annular member in response to a pressure differential between the inside of each bellows member and the outer surface of each bellows member. In an alternate embodiment, a housing is provided over each bellows member, wherein each housing is equipped with lower fitting and an upper flange selectively attachable to one of a lower flange on a lower end of the motor and a lower fitting on another housing. In an alternate embodiment, a sensor mounts to the lower fitting on a housing of a lowermost bellows member in the string and an umbilical for communication between the sensor and surface, wherein the umbilical is routed through the conduit

BRIEF DESCRIPTION OF THE DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
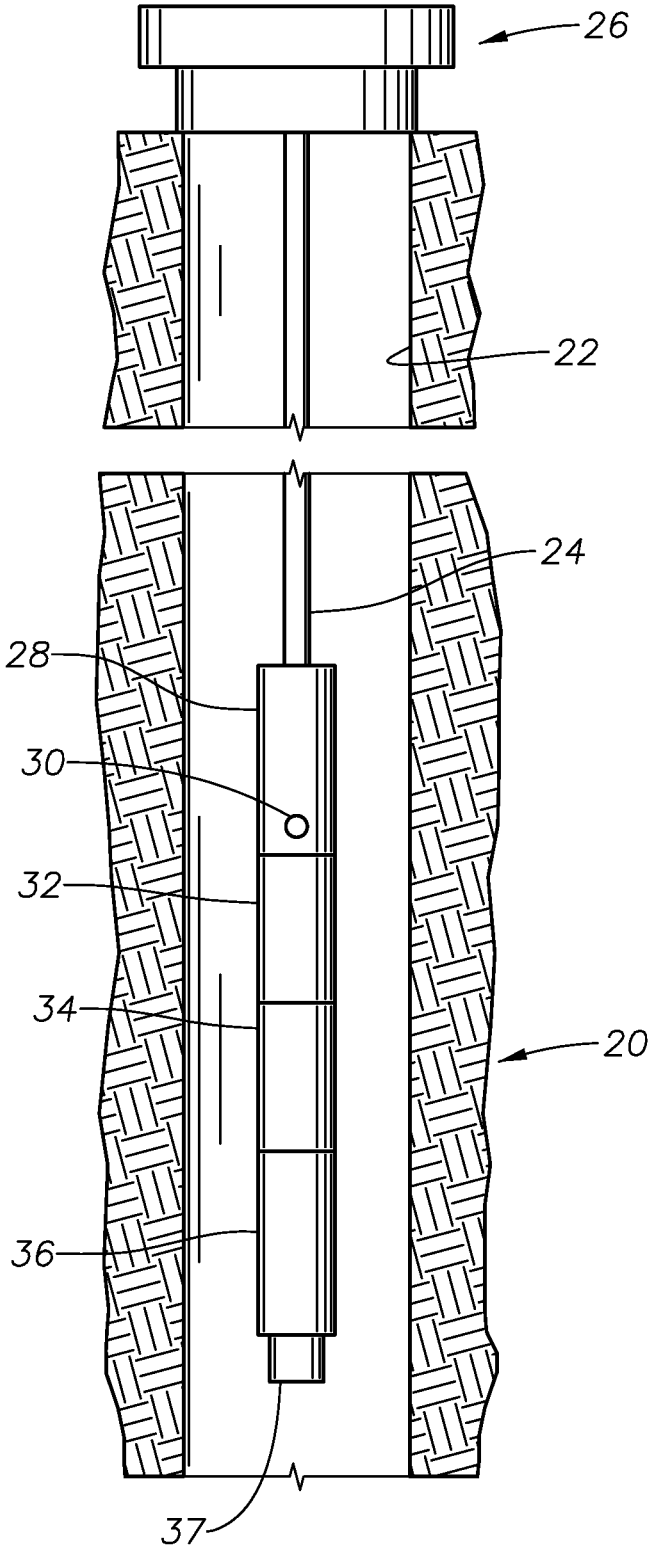
FIG. 1 is a side sectional view of a submersible pumping system disposed in a wellbore.

Referring now to FIG. 1, a side schematic view of an ESP system 20 is illustrated disposed in a wellbore 22 and suspended on production tubing 24 from a wellhead assembly 26. In the embodiment of FIG. 1, the ESP system 20 includes a pump 28 on its upper end for pressuring production fluid from within the wellbore 22. The pressurized fluid exits the pump 28 into the production tubing 24 for delivery to the wellhead assembly 26. Production fluid may enter into the pump 28 via an inlet 30 shown formed on the pump 28 and through an outer housing of the pump 28. Fluid from the wellbore 22 flows through fluid inlet 30 of pump 28 to be pressurized. A thrust assembly 32 is shown coaxially provided within the ESP system 20 and mounted below the pump 28. A pump motor 34 attaches to a lower end of the thrust assembly 32 distal from the end where the thrust assembly 32 connects with the pump 28. In the embodiment of FIG. 1, the motor 34 couples to the pump 28 via a shaft (not shown) and thrust assembly 32 for providing rotational energy to the pump 28. A modular pressure equalizer 36 is illustrated attached to the lower end of the motor 34. The pressure equalizer 36 equalizes pressure ambient within the wellbore 22 to fluids within the ESP system 20; such as dielectric fluid within the motor 34, and alleviates mechanical loading on pressure seals within the ESP system 20.

An optional gauge 37 is shown attached to the pressure equalizer 36. In an example embodiment, the gauge 37 is coupled with the umbilical 45 for measuring conditions downhole and providing data signals representing the measured signals through the umbilical 45 to a monitoring system (not shown). Embodiments exist wherein the umbilical 45 connects to windings (not shown) in the motor 34 so the signals travel through the windings and a power cable energizing the motor 34. Optionally, a dedicated line can connect between the umbilical 45 and monitoring system. Examples of measured conditions include temperature, pressure, and fluid properties. The gauge 37 may be attached to an end of the pressure equalizer 36 distal the end of attachment to the motor 34 or another upwardly disposed pressure equalizer. The motor 34 can generate heat to an already heated area, thus an advantage of setting the gauge 37 away from the motor 34 is an easing of environmental conditions experienced by the gauge 37 potentially prolonging the useful life of the gauge 37.

Figure 2:
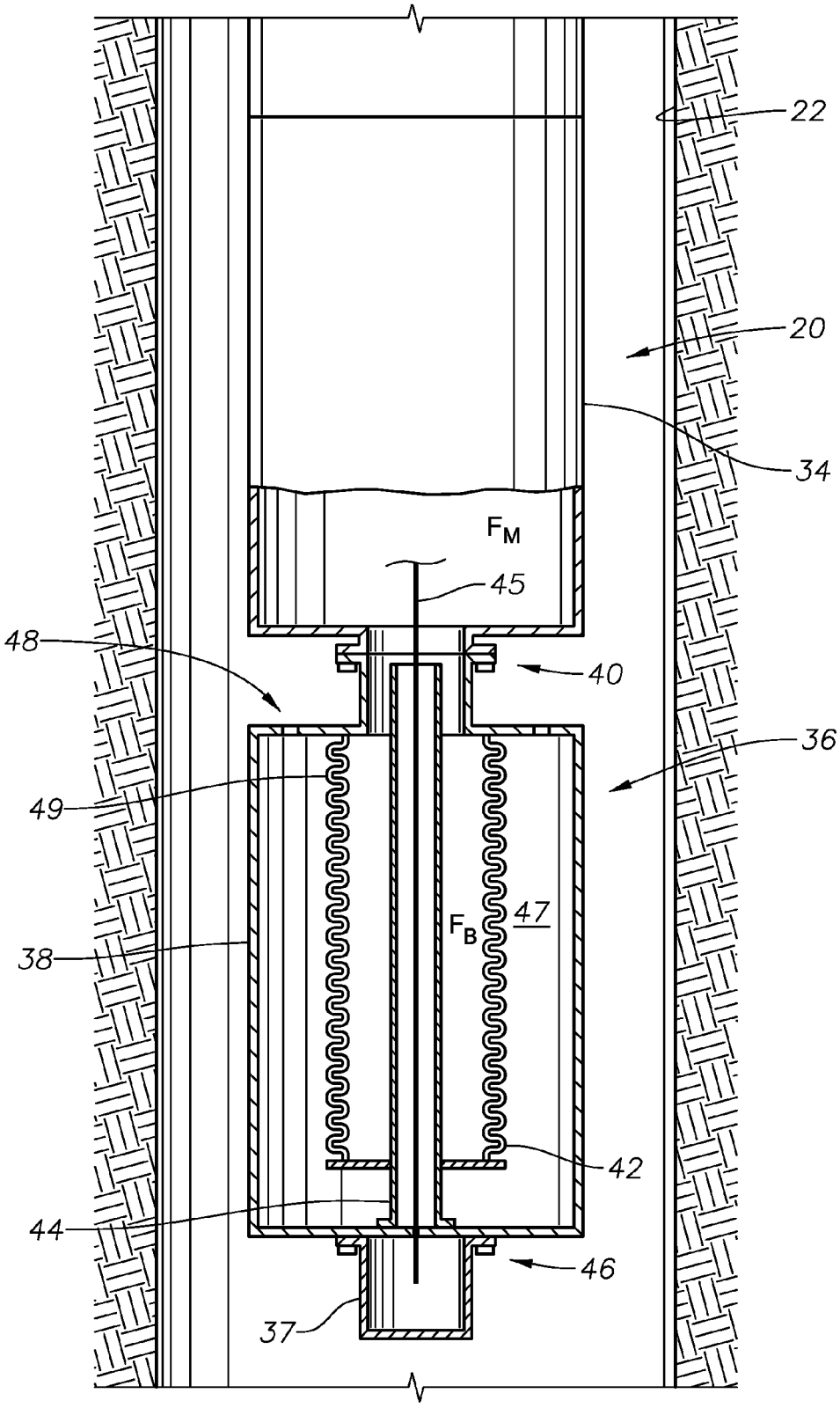
FIG. 2 is a side schematic partial sectional view of the ESP of FIG. 1.

Referring now to FIG. 2, provided is a side partial sectional view of a portion of the ESP 20 of FIG. 1 that illustrates in more detail an embodiment of the pressure equalizer 36. In this example embodiment the pressure equalizer 36 is shown having an outer annular rigid housing 38 bolted to a lower end of the motor 34 by an adapter flanged head 40. A bellows 42 is illustrated concentrically provided within the housing 38. An inner annulus in the flanged head 40 provides fluid communication from within the motor 34 to the inside of the bellows 42. An elongated tubular conduit 44 is provided within the motor 34 and having an umbilical 45 within. The conduit 44 and umbilical 45 extend from within the motor 34, through the annulus of the flanged head 40, into the bellows 42, and exit a lower lateral wall of the bellows 42.

A plenum 47 is defined in the space between the outer periphery of the bellows 42 and inner surface of the housing 38. Fluid inlets 48 are shown formed through a wall of the housing 38, thereby providing communication between the plenum 47 and within the wellbore 22. The radial wall of the bellows 42 is formed of a number of folds 49 that are accordion shaped to allow expansion and/or contraction of the bellows 42. The bellows 42 can lengthen and extend when expanding and shorten when contracting. Fluid FB is provided within the bellows 42 and fluid FM is provided within the motor 34, fluids FB and FM are in pressure communication with one another via the annulus of the adapter flanged head 40. Pressure in the plenum 47 will be substantially at pressure within the wellbore 22 due to pressure communication through the fluid inlets 48 in the housing 38. Pressure differentials between the plenum 47 and bellows fluid FB produce a resultant force on the bellows 42 causing expansion or contraction of the folds 49 to equalize pressure inside the bellows FB to the pressure inside the plenum 47, which is substantially the same as pressure in the wellbore 22. Pressure communication between the bellows fluid FB and motor fluid FM through the flanged head 40, thereby equalizes pressure within the motor 34 and pressure in the wellbore 22. As noted above, minimizing the pressure differential within the motor 34 and the wellbore 22 in turn minimizes loading on seals (not shown) within the ESP 20 the sidewalls of the ESP 20.

Figure 3:
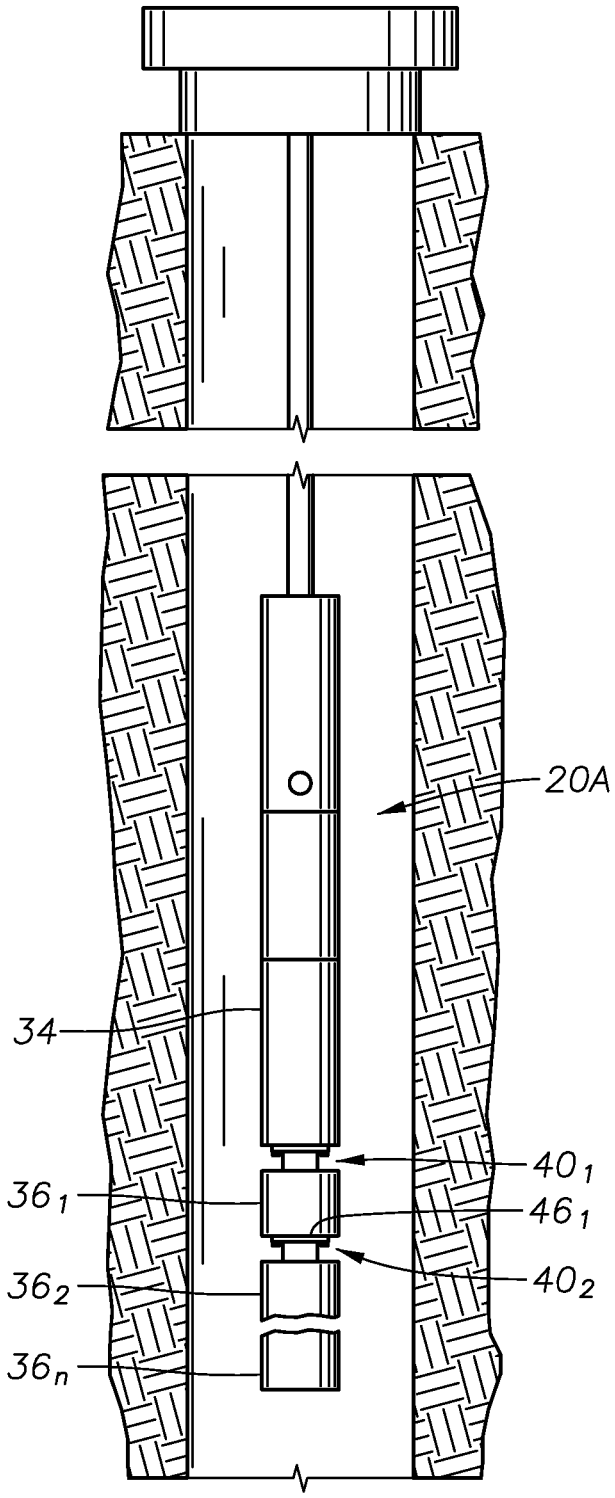
FIG. 3 is a side schematic view of an alternate ESP in a wellbore.

Schematically illustrated in FIG. 3 is an alternative embodiment of an ESP system 20A disposed in a wellbore 22 and having a series of pressure equalizers $\mathbf{36}_1$-$\mathbf{36}_n$. In this example, multiple modules $\mathbf{36}_1$-$\mathbf{36}_n$ are shown mounted on a lower end of the motor 34. The multiple modules $\mathbf{36}_1$-$\mathbf{36}_n$ may be required to provide an amount of fluid capacity to ensure a sufficient amount of equalizing fluid is included with the ESP system 20A. In an example embodiment, each module $\mathbf{36}_i$ mounts to an upper module $\mathbf{36}_{i-1}$ by bolting the flanged fitting 40, to the flanged mounting $\mathbf{46}_{i-1}$ on a lower end of the upper module $\mathbf{36}_{i-1}$.

Figure 4:
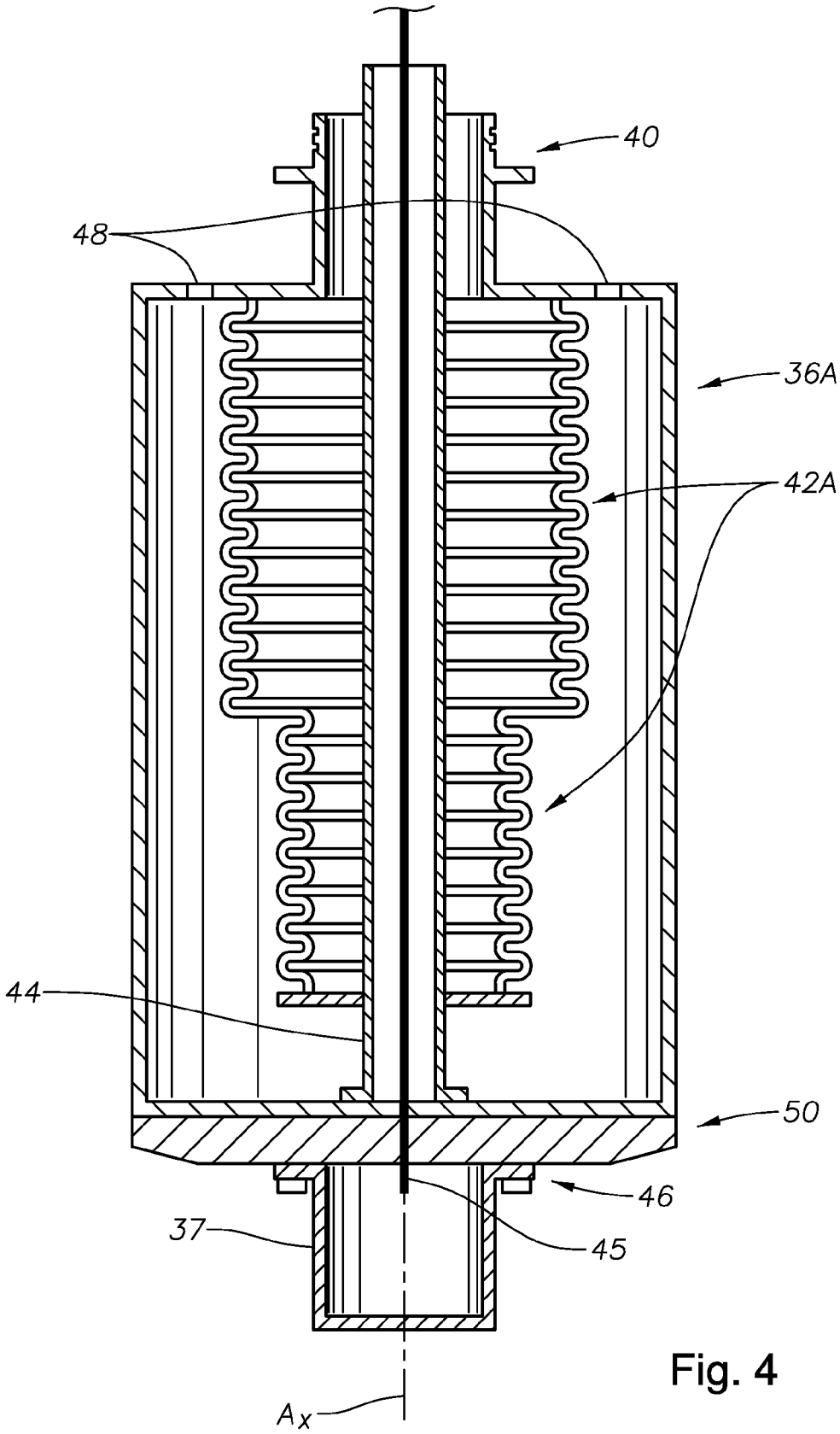
FIG. 4 is a side partial sectional view of a bellows portion of an ESP.

Shown in a side sectional view in FIG. 4 is an alternative embodiment of a pressure equalizer 36A and having a segmented bellows 42A. In this example, one portion of the segmented bellows 42A has a greater outer circumference than an adjoining portion of the segmented bellows 42A. Shown provided along an axis $A_X$ of the segmented bellows 42A is conduit 44 having umbilical 45 coaxially disposed therein. Optionally shown on the lower end of the pressure equalizer 36A of FIG. 4 is an adapter base 50 on which the flanged mounting 46 is provided for connection of the gauge 37, another pressure equalizer 36 (FIG. 3), or some other device or attachment. In the example embodiment, the base 50 is a disk like member mounted transverse to the axis $A_X$. In another example embodiment, the bellows 42 can be capped or completed by a plug (not shown) if required.

Example materials for the bellows include metal alloys, that in one optional embodiment are resistant to high temperatures and compounds in the wellbore (either connate or injected from surface) that are corrosive and/or aggressive. The metallic bellows material enables an equalization assembly to have a low elastomeric content. Although shown as a flange and bolt arrangement, the attachment for pressure equalizer 36 may include threads or welds for coupling to the motor 34 or other pressure equalizers 36. It should be pointed out that in the example of FIG. 3, in embodiments using bellows 42 within the pressure equalizers, the size of the bellows within each individual pressure equalizer may be different or have a different configuration, such as that of FIG. 4.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, modular pressure equalizers may comprise elastomeric membranes in combination with the bellows 42. Optionally, the membranes can be included in one or more of the pressure equalizers in place of the bellows 42. These and other similar modifications will readily suggest themselves to those skilled in the art, and are intended to be encompassed within the spirit of the present invention disclosed herein and the scope of the appended claims.

The invention claimed is:

1. An electrical submersible pumping (ESP) system disposable in a wellbore comprising:

a pump;

a pump motor for driving the pump;

at least one pressure equalizer removeably mounted to an end of the pump motor distal from the pump and having a first bellows with an inside of the first bellows in pressure communication with the pump motor and an outer surface of the first bellows in pressure communication with the wellbore;

a sensor fitting below the first bellows;

a sensor mounted on the sensor fitting; and a conduit in pressure communication with the motor and that extends from inside of the first bellows to the sensor fitting.

2. The ESP system of claim 1, wherein the at least one pressure equalizer comprises a first pressure equalizer and a second pressure equalizer mounted to and below the first pressure equalizer the second pressure equalizer having a second bellows with an inside of the second bellows in pressure communication with the pump motor and an outer surface of the second bellows in pressure communication with the wellbore, and wherein the sensor fitting is below the second bellows.

3. The ESP system of claim 2, wherein the at least one pressure equalizer comprises a third pressure equalizer having a third bellows mounted to and below the second pressure equalizer, and wherein the sensor fitting is attached to a lower end of the third pressure equalizer.

4. The ESP system of claim 2, wherein the first pressure equalizer further comprises a housing enclosing the first bellows with an upper end of the first bellows attached to a surface within the housing, a plenum defined in the space between side walls of the first bellows and the housing, a flanged upper fitting on an upper end of the housing for attaching the first pressure equalizer to the motor and for communicating pressure between the inside of the first bellows and the motor, and a fluid inlet formed through the housing for providing fluid communication between the wellbore and the outer surface of the first bellows.

5. The ESP system of claim 1, further comprising an umbilical inserted through the conduit for transmitting data from the sensor to the surface.

6. The ESP system of claim 1, wherein the first bellows comprises an annular member arranged with folds in a side wall of the annular member for axially fluctuating a length of the annular member in response to a pressure differential between the inside of the first bellows and the outer surface of the first bellows.

7. The ESP system of claim 1, further comprising a thrust assembly disposed between the pump motor and the pump.

8. A submersible pump assembly for lifting fluids from a wellbore comprising:

a pump;

a pump motor mounted below the pump;

a string of pressure equalizers attached in series on a lower end of the pump motor, each pressure equalizer having an annular bellows member configured so that an inside of each bellows member is in pressure communication with the pump motor and an outer surface of each bellows member is in pressure communication with the wellbore, and at least one of the bellows members having a larger diameter portion with a varying outer diameter to define undulations, and a smaller diameter portion with a varying outer diameter to define undulations with a maximum outer diameter less than a maximum outer diameter of the larger diameter portion;

a sensor fitting at the lower end of the string of pressure equalizers;

a conduit extending axially through each of the bellows members that has an upper end in pressure communication with the motor and a lower end at the sensor fitting; and a sensor mounted to the sensor fitting and an umbilical for communication between the sensor and surface, wherein the umbilical is routed through the conduit.

9. The submersible pump assembly of claim 8, further comprising a housing provided over each bellows member, wherein each housing is equipped with a lower fitting and an upper flange selectively attachable to one of a lower flange on a lower end of the motor and a lower fitting on another housing, and wherein the lower fitting on the housing of lowermost of the pressure equalizers comprises the sensor fitting.

* * * * *